US005492801A

United States Patent [19]

Maskasky

[11] Patent Number: 5,492,801

[45] Date of Patent: Feb. 20, 1996

[54] EMULSIONS WITH TABULAR GRAIN MAJOR FACES FORMED BY REGIONS OF DIFFERING IODIDE CONCENTRATIONS

[75] Inventor: Joe E. Maskasky, Rochester, N.Y.

[73] Assignee: Eastman Kodak Company, Rochester, N.Y.

[21] Appl. No.: 394,988

[22] Filed: Feb. 27, 1995

[51] Int. Cl.[6] ..... G03C 1/035

[52] U.S. Cl. ..... 430/567

[58] Field of Search ..... 430/567

[56] References Cited

U.S. PATENT DOCUMENTS

| | | | |
|---|---|---|---|
| 4,439,520 | 3/1984 | Kofron et al. | 430/434 |
| 4,504,570 | 3/1985 | Evans et al. | 430/217 |
| 4,665,012 | 5/1987 | Sugimoto et al. | 430/569 |
| 4,934,037 | 7/1990 | Saitou | 430/567 |
| 5,250,403 | 10/1993 | Antoniades et al. | 430/569 |

FOREIGN PATENT DOCUMENTS

| | | | |
|---|---|---|---|
| 1027146 | 4/1966 | United Kingdom | 430/569 |

OTHER PUBLICATIONS

Bando et al, "Photographic Silver Halide Emulsion Containing Double Structure Grains", *J. of Imaging Science*, vol. 29, No. 5, Sep./Oct. 1985, pp. 193–195.

*Primary Examiner*—Janet C. Baxter
*Attorney, Agent, or Firm*—Carl O. Thomas

[57] ABSTRACT

Radiation-sensitive emulsions are disclosed comprised of high bromide tabular grains having {111} major faces wherein a portion of the {111} major faces is formed by a central region containing at least 7 mole percent iodide and an annular band extends outwardly from the central region forming a second portion of the {111} major faces and contains less than half the iodide of the central region. The emulsions combine the advantages of both high and low surface iodide tabular grain emulsions.

7 Claims, 2 Drawing Sheets

EMULSIONS WITH TABULAR GRAIN MAJOR FACES FORMED BY REGIONS OF DIFFERING IODIDE CONCENTRATIONS

FIELD OF THE INVENTION

The invention is directed to radiation-sensitive photographic emulsions useful in photography.

BACKGROUND

Figure 1:
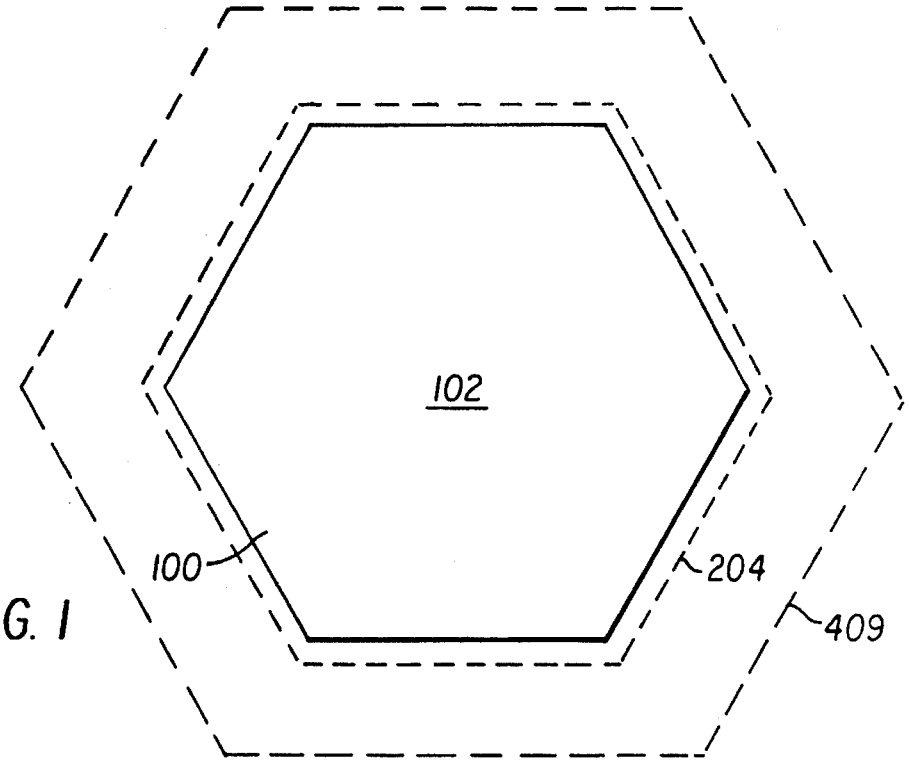
FIG. 1 is a plan view of a tabular grain with dashed lines added to demonstrate two alternate growth patterns.

During the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multi-emulsion layer formats, can be realized by increasing the proportions of selected high (>50 mole bromide tabular grain populations in photographic emulsions.

The advantages of tabular grain emulsions stem from the high proportion of tabular grains-that is, grains with parallel {111} major faces, having a relatively large equivalent circular diameter (ECD) as compared to their thickness (t). By increasing the percentage of total grain projected area accounted for tabular grains, increasing the aspect ratio of the tabular grains (ECD÷t), and decreasing grain thickness, the advantages imparted by tabular grain geometries can be enhanced.

From the very outset it was recognized that tabular grains with {111} major faces could be prepared by introducing parallel twin planes in the face centered cubic crystal lattice structure of silver bromide grains. It was subsequently discovered that the desired tabular grain characteristics could, with proper precautions, be maintained when amounts of iodide ranging up to its solubility limit in silver bromide were incorporated. Kofron et al U.S. Pat. No. 4,439,520 was the first to report silver bromide and iodobromide high aspect ratio (ECD/t>8) tabular grain emulsions chemically and spectrally sensitized to yield high levels of photographic performance.

The concept of core-shell silver iodobromide photographic emulsions has been known for at least 28 years, as illustrated by Klein and Moisar UK Patent 1,027,146 (1966). These silver iodobromide grains, sometimes also referred to as "double structure" grains, have a relatively high iodide core and a relatively low iodide shell. They have a number of art-recognized advantages. Bando et al, "Photographic Silver Halide Emulsion Containing Double Structure Grains", *J. of Imaging Science,* Vol. 29, No. 5, Sept/Oct 1985, pp. 193–195, demonstrated that double structured octahedral grains have increased blue absorption and good development activity. Additionally, the photoelectrons generated in the core can take part in the formation of a surface latent image as efficiently as those generated in the shell. Finally, the grains have reduced dye desensitization compared to grains with the same overall amounts of iodide, but uniformly distributed. Investigations have suggested that the reduced dye desensitization is caused by the capture of positive holes in the relatively high iodide core.

Kofron et al, cited above, suggested creating high bromide tabular grains with core-shell structures. Evans et al U.S. Pat. No. 4,504,570 suggested tabular grains with core-shell structures internally modified to form a predominantly internal latent image. Saitou U.S. Pat. No. 4,945,037 discloses core-shell tabular grain structures with either (I) limited iodide concentrations in the shell or (II) at least 6 mole % iodide in the shell, each structure giving a different effect. Saitou et al contemplates the shell to be at least 0.01 μm in thickness.

Figure 2:
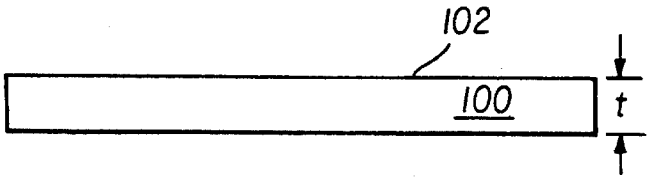
FIG. 2 is a sectional view of the tabular grain of FIG. 1.

There are fundamental problems in shelling high bromide tabular grain emulsions. One problem is illustrated by reference to FIGS. 1 to 3. In FIGS. 1 and 2 a high bromide tabular grain 100 is shown. The upper major face 102 of the tabular grain is large compared to its thickness t. It is the large upper major face available to capture exposing radiation and the limited thickness of the tabular grain that provide the advantages of this grain shape.

Figure 3:
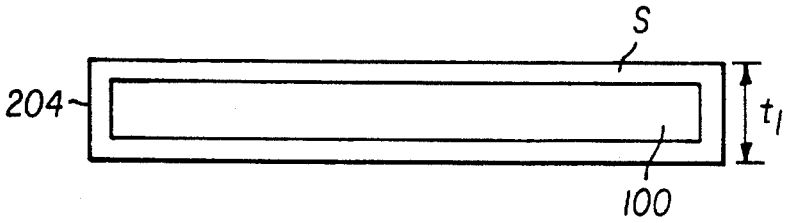
FIG. 3 is a sectional view of the tabular grain of FIGS. 1 and 2 with conventional shelling.

If a conventional shelling procedure is followed, the grain structure shown in FIG. 3 results. Although the shell S produces a layer of uniform thickness on all external surfaces of the grain 100, the additional silver halide precipitated to form the shell is located primarily on the major faces of the original tabular grains. Only a very small fraction of the additionally deposited silver halide is located on the edges of the tabular grain 100, since the edge surface area of the tabular grain 100 is small compared the surface area of the major faces. The shell increases the projected area of the tabular grain available to capture exposing radiation only slightly. This is shown by comparing the location of the peripheral edge 204 of the shelled grain to that of tabular grain 100 in FIG. 1. However, the thickness $t_1$ of the shelled tabular grain shows a high percentage increase when compared to the thickness t of tabular 100.

Stated another way, conventional shelling procedures degrade desirable tabular grain properties. Tabular grain projected area is increased little, while tabular grain aspect ratio is reduced significantly and tabular grain thickness is increased significantly.

Another disadvantage of a core-shell grain structure is that the outer surface of the tabular grains must necessarily be of the composition of the shell. Although the shell may vary in thickness, it nevertheless surrounds the core and imparts to the entire surface of the tabular grain a single composition.

Maskasky U.S. Pat. No. 5,411,851 discloses a process for the preparation of an ultrathin (<0.07 μm) high (>50 mole %) bromide tabular grain emulsion by employing a triaminopyrimidine grain growth modifier containing mutually independent 4, 5 and 6 ring position amino substituents, the 4 and 6 ring position substituents being hydroamino substituents.

Maskasky U.S. Pat. No. 5,418,125 discloses a process for the preparation of an ultrathin high bromide tabular grain emulsion by employing an 8-iodo substituted quinoline grain growth modifier.

RELATED PATENT APPLICATION

Maskasky U.S. Ser. No. 394,987, filed concurrently, titled TABULARLY BANDED EMULSIONS WITH HIGH CHLORIDE CENTRAL PORTIONS, commonly assigned, discloses high chloride tabular grain emulsions in which the tabular grains contain a peripheral tabular band containing a lower proportion of chloride, typically a high bromide tabular band.

SUMMARY OF THE INVENTION

In one aspect the invention is directed to a radiation-sensitive emulsion comprised of a dispersing medium and silver halide grains, at least 50 percent of total grain projected area being accounted for by tabular grains of a face centered cubic crystal lattice structure comprised of greater than 50 mole percent bromide and having parallel {111} major faces and an average aspect ratio of at least 5, the tabular grains being comprised of regions differing in iodide concentrations, wherein one of the regions is a central region containing greater than 7 mole percent iodide, a second of the regions is an annular band containing less than half the iodide concentration of the central region, and the central region and the annular band each extend between and form a portion of the {111} major faces, with the central region and annular band each forming at least 5 percent of each {111} major face.

The present invention offers a combination of advantages not previously realized in the art. Since regions of differing iodide concentrations are both present at the major faces of the tabular grains, the advantages of relatively high surface iodide concentrations as well as the advantages of relatively low surface iodide concentrations can be realized in the same grain structure. By contrast, conventional core-shell structures have required a choice of either high or low iodide concentrations at the grain surface.

An advantage of forming a portion of the major faces of the tabular grains with a low iodide band is that photoholes migrate away from the annular band, thereby enhancing the formation of latent images at the band surfaces. At the same time, the relatively low iodide concentration within the annular band contributes to enhanced developability as development commences at the surface latent image sites. Since latent images normally tend to form at the periphery of tabular grains, forming the tabular trains with annular bands of a composition most conductive to latent image formation and development is particularly advantageous.

An advantage of forming a portion of the major faces of the tabular grains with a relatively high iodide concentration is that high surface iodide improves the sensitization efficiency of adsorbed spectral sensitizing dye as well as improving the absorption of other useful photographic addenda, such as antifoggants and stabilizers.

Another advantage of the present invention is that differences in iodide concentrations within the grain are realized while at the same time enhancing performance characteristics attributable to tabular grain geometry by increasing tabular grain projected area without a concomitant increase in tabular grain thickness. In fact, significant increases in tabular grain projected area have been achieved without any measurable increase in tabular grain thickness.

DESCRIPTION OF PREFERRED EMBODIMENTS

Figure 4:
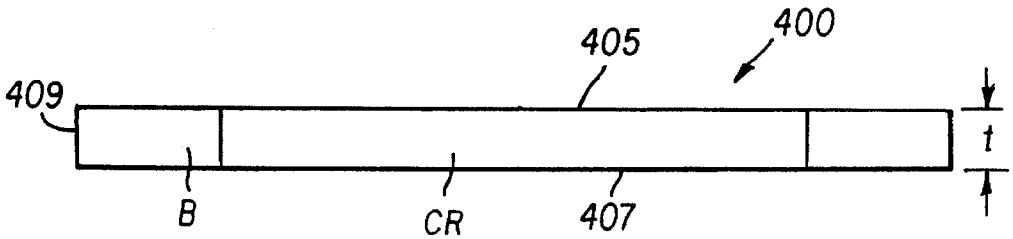
FIG. 4 is a sectional view of a tabular grain satisfying the requirements of the invention.

In FIG. 4 a tabular grain 400 is shown that illustrates the unique features of the emulsions of the invention. A central region CR extends between and forms a portion of the {111} major faces 405 and 407 of the tabular grain. Extending outwardly from the central region and also forming a portion of the {111} major faces of the tabular grain is an annular band B.

The advantages that the tabular grain 400 provides over a conventional core-shell grain structure is apparent by comparing it to the shelled grain in FIG. 3, where an equal amount of silver halide is contained in the shell S and the annular band B. The core-shell grain structure thickens the grain as indicated at $t_1$, whereas the annular band is shown to be grown laterally while retaining the original thickness t of the tabular grain central region. Adding a shell S to grain 100 only slightly increases the projected area of the tabular grain, as is best seen in FIG. 1 by the location of the peripheral edge 204. On the other hand, the preferential location of the band at the outer edge of the grain contributes to a relatively large increase in tabular projected area, as shown by the location of the peripheral edge 409 in FIG. 1.

To realize the performance advantages of relatively high and low surface iodide concentrations at the {111} major faces of the tabular grains it is necessary that at least 5 percent of the {111} major faces be formed by each of the central region and the annular band. For example, the central region can account for a minimum of 5 percent (preferably at least 20 percent) of the {111} major faces with the annular band accounting for the remainder of the major faces, at most 95 percent (preferably up to 80 percent).

It is, in fact, preferred that the central region account for as much of the {111} major faces as feasible. Thus the central region preferably accounts for at least 80 percent (most preferably up to 95 percent) of the {111} major faces with the annular band accounting for the remainder. The annular band can easily provide formation sites for substantially all of the latent image, even when it accounts for only 5 percent of the (111} major faces. The annular band preferably forms no more than 20 percent of the {111} major faces. By increasing the area of the {111} major faces formed by the central region the area for efficient interaction between adsorbed spectral sensitizing dyes and the grain surface is increased while still affording adequate area for latent image formation in the annular band.

The central region contains at least 7 mole percent iodide and can contain iodide concentrations of up to the solubility limit of iodide in the face centered cubic crystal lattice structure of the grain, nominally taken as about 40 mole percent, depending upon the exact choice of conditions chosen for grain growth. Iodide concentrations of up to about 30 mole percent are readily realized with a broad range of conventional precipitation techniques and are therefore preferred. Native blue absorption is increased as a direct function of increasing iodide concentration. However, where advantages related to dye adsorption and/or sensitizing efficiency are sought independently of increased blue sensitivity (that is, for emulsions that are intended to be sensitized to the green and/or red, also referred to as minus blue, regions of the spectrum), fully adequate enhancements can be realized with iodide concentrations of less than 20 mole percent.

The annular band is chosen to contain less than half of the iodide concentration of the central region. Only low levels of iodide in the annular band are required to improve latent image formation efficiency. Hence it is preferred that the annular band contain less than 2 mole percent iodide. To realize the advantages of the presence of iodide, it is contemplated that the annular band will contain at least 0.1 mole percent iodide, preferably at least 0.5 mole percent iodide.

The radiation-sensitive emulsions of the invention are comprised of tabular grains accounting for at least 50 percent of total grain projected area having structural features of the type described for grain 400. Preferably these tabular grains account for at least 70 percent of total grain projected area and optimally at least 90 percent of total grain projected area. These tabular grains have an average aspect ratio of at least 5, preferably >8. Since the tabular grains are actually increased in aspect ratio by band formation according to the teachings of the invention, the tabular grain emulsions of the invention can have average aspect ratios equaling or exceeding the highest average aspect ratios reported for high bromide tabular grain emulsions.

Subject to the iodide incorporation requirements discussed above, the central regions of the tabular grains of this invention can correspond to conventional high bromide tabular grains, which provide convenient starting materials for the formation of the tabular grain emulsions of the invention. Conventional high bromide tabular grain emulsions that can be employed to provide the central regions of the grains of this invention are illustrated by the following, the disclosures of which are incorporated by reference:

Wilgus et al U.S. Pat. No. 4,434,226;
Kofron et al U.S. Pat. No. 4,439,520;
Daubendiek et al U.S. Pat. No. 4,414,310;
Solberg et al U.S. Pat. No. 4,433,048;
Yamada et al U.S. Pat. No. 4,647,528;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Black et al U.S. Pat. No. 5,334,495;
Chaffee et al U.S. Pat. No. 5,358,840; and
Delton U.S. Pat. No. 5,372,927.

The high bromide tabular grain emulsions employed to prepare the central regions of the tabular grains of the invention contain at least 50 mole percent and preferably at least 70 mole percent bromide, based on total silver. The emulsions can be silver iodobromide emulsions or the tabular grains can contain minor amounts of chloride, consistent with the iodide and bromide concentration ranges noted above.

The high bromide tabular grain emulsions used to provide the central regions of the tabular grain emulsions of the invention can have any average aspect ratio compatible with achieving an average aspect ratio of at least 5 in the final emulsion. Since the band structure added disproportionately increases tabular grain ECD as compared to tabular grain thickness, the starting emulsion can have an average aspect ratio somewhat less than 5, but the aspect ratio is preferably at least 5. The starting emulsion can have any convenient conventional higher average aspect ratio, such as any average aspect ratio reported in the patents cited above.

The average thickness of the high bromide tabular grains employed to form the central regions can take any value compatible with achieving the required final average aspect ratio of at least 5. It is generally preferred that the thickness of the grains forming the central region be less than 0.3 μm. Thin tabular grain emulsions, those having an average thickness of less than 0.2 μm, are preferred. It is specifically contemplated to employ as starting materials ultrathin tabular grain emulsions—i.e., those having an average tabular grain thickness of <0.07 μm. High bromide ultrathin tabular grain emulsions are included among the emulsion disclosures of the patents cited above to show conventional high bromide tabular grain emulsions and are additionally illustrated by the following:

Zola and Bryant EPO 0 362 699;
Antoniades et al U.S. Pat. No. 5,250,403; and
Sutton et al U.S. Pat. No. 5,334,469.

It is additionally preferred to select host high bromide tabular grain emulsions to exhibit limited grain dispersity. That is, the high bromide tabular grain emulsions are preferably selected so that both the starting emulsions and the completed emulsions satisfying the requirements of the invention are monodisperse. That is, the emulsions exhibit a coefficient of variation (COY) of grain ECD of less than 30 percent, where COY is defined as 100 times the standard deviation of grain ECD divided by average grain ECD. Generally the advantages of monodispersity are enhanced as COY is decreased below 30 percent. High bromide tabular grain emulsions useful in forming the central regions of the shelled grains of the emulsions of this invention are known to the art exhibiting COY values of less than 15 percent and, in emulsions where particular care has been exercised to limit dispersity, less in 10 percent. Low COY high bromide tabular grain emulsions are included among the emulsion disclosures of the patents cited above to show conventional high bromide tabular grain emulsions and are additionally illustrated by the following:

Saito et al U.S. Pat. No. 4,797,354;
Tsaur et al U.S. Pat. No. 5,210,013;
Kim et al U.S. Pat. No. 5,272,048; and
Sutton et al U.S. Pat. No. 5,334,469.

Low COY host tabular grains can be banded according to the invention while maintaining low grain size dispersity.

The high bromide tabular grain emulsions employed as starting materials have tabular grain projected areas sufficient to allow the tabular grains in the final emulsion to account for at least 50 percent of total grain projected area. The preferred starting materials are those that contain tabular grain projected areas of at least 70 percent and optimally at least 90 percent. Generally, the exclusion of non-tabular grains to the extent conveniently attainable is preferred.

It has been discovered quite unexpectedly that a few of the many known grain growth modifiers that produce high chloride tabular grains can be used to produce an annular band structure on a pre-existing high bromide tabular grain population without creating a shell. That is, as the band is formed silver halide is deposited preferentially onto the peripheral edges of the host high bromide tabular grains and precipitation onto the major faces of the high bromide tabular grains either does not occur or is too limited to reduce the iodide concentration below the levels required by the invention at the {111} major faces. In fact, in preferred embodiments of the invention, precipitation onto the major faces of the pre-existing tabular grains is such that it has not been possible to detect its presence.

The following conventional grain growth modifiers have not been found to be useful in achieving band formation satisfying the requirements of the invention: adenine, xanthine and 4-aminopyrazolo-[3,4-d] pyrimidine. Grain growth modifiers of these types are disclosed in Maskasky U.S. Pat. Nos. 4,400,463, 4,713,323 and 5,183,732, Maskasky and Chang U.S. Pat. No. 5,178,998, Tufano et al U.S. Pat. No. 4,804,621 and Houle et al U.S. Pat. No. 5,035,992.

Grain growth modifiers of the 4,5,6-triaminopyrimidine type have been observed to be useful in growing tabular bands on high bromide tabular grain emulsions. These grain growth modifiers satisfy the following formula:

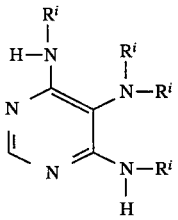

(I)

where $R^i$ is independently in each occurrence hydrogen or a monovalent hydrocarbon group of from 1 to 7 carbon atoms of the type indicated above, preferably alkyl of from 1 to 6 carbon atoms.

The following are illustrations of varied 4,6-di(hydroamino)-5-aminopyrimidine compounds within the purview of the invention:

4,5,6-Triaminopyrimidine PY-1

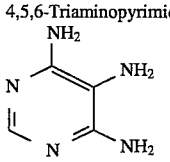

5,6-Diamino-4-(N-methylamino)pyrimidine PY-2

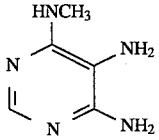

4,5,6-Tri(N-methylamino)pyrimidine PY-3

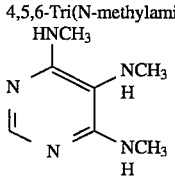

4,6-Diamino-5-(N,N-dimethylamino)pyrimidine PY-4

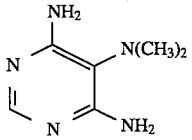

4,6-Dimaino-5-(N-hexylamino)pyrimidine

-continued PY-5

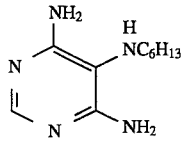

Starting with a conventional high bromide tabular grain emulsion of the type described above an aqueous dispersion is prepared containing at least 0.1 percent by weight silver, based on total weight, in the form of grains supplied by the starting emulsion. The weight of silver in the dispersing medium can range up to 20 percent by weight, based on total weight, but is preferably in the range of from 0.5 to 10 percent by weight, based on the total weight of the dispersion.

The aqueous dispersion also receives the water and peptizer that are present with the high bromide tabular grains in the starting emulsion. The peptizer typically constitutes from about 1 to 6 percent by weight, based on the total weight of the aqueous dispersion. In the simplest mode of practicing the invention, the tabular band growth process of the invention is undertaken promptly upon completing precipitation of the high bromide tabular grain emulsion, and only minimum required adjustments of the dispersing medium of the starting emulsion are undertaken to satisfy the aqueous dispersion requirements of the tabular band growth process. Intermediate steps, such as washing, prior to commencing the tabular band growth process are not precluded.

The pH of the aqueous dispersion employed in the tabular band growth process is in the range of from 4.6 to 9.0, preferably 5.0 to 8.0. Adjustment of pH, if required, can be undertaken using a strong mineral base, such as an alkali hydroxide, or a strong mineral acid, such as nitric acid or sulfuric acid. If the pH is adjusted to the basic side of neutrality, the use of ammonium hydroxide should be avoided, since under alkaline conditions the ammonium ion acts as a ripening agent and will increase grain thickness.

To minimize the risk of elevated minimum densities in the emulsions prepared, it is common practice to prepare photographic emulsions with a slight stoichiometric excess of bromide ion present. At equilibrium the following relationship exists:

$$-\log K_{sp}=pBr+pAg \quad (I)$$

where $K_{sp}$ is the solubility product constant of silver bromide;

pBr is the negative logarithm of bromide ion activity; and pAg is the negative logarithm of silver ion activity.

The solubility product constant of silver bromide emulsions in the temperature range of from 0° to 100° C. has been published by Mees and James *The Theory of the Photographic Process,* 3th Ed., Macmillan, New York, 1966, page 6. The equivalence point, pBr=pAg=$-\log K_{sp}+2$, which is the point at which no stoichiometric excess of bromide ion is present in the aqueous dispersion, is known from the solubility product constant. By employing a reference electrode and a sensing electrode, such as a silver ion or bromide ion sensing electrode or both, it is possible to determine from the potential measurement of the aqueous dispersion its bromide ion content (pBr). Lin et al U.S. Pat. No. 5,317,521, is here incorporated by reference to show electrode selections and techniques for monitoring pBr. To avoid unnecessarily high bromide ion concentrations in the aqueous dispersion (and hence unnecessary waste of materials) the pBr of the aqueous dispersion is adjusted to at least 1.5, preferably at least 2.0 and optimally greater than 2.6. Soluble bromide salt (e.g. alkali bromide) addition can be used to decrease pBr while soluble silver salt (e.g. silver nitrate) additions can be used to increase pBr.

The triaminopyrimidine grain growth modifier is added to the aqueous dispersion, either before, during or following the pBr and pH adjustments indicated.

One of the surprising discoveries has been that grain growth modifiers that function similarly as the triaminopyrimidines of the invention when employed in the preparation of high chloride {111} tabular grain emulsions are not effective when substituted for the grain growth modifiers of the invention in the tabular band growth process.

It is believed that the effectiveness of the grain growth modifier to produce tabular bands is attributable to its preferential absorption to {111} crystal faces and its ability to preclude additional silver halide deposition on these surfaces. This explanation does not, however, explain the failure of other grain growth modifiers that are also believed to perform the same function. Actual observations indicate that the interactions between the various grain surfaces present in the aqueous dispersion and the grain growth modifier are, in fact, complex. Why one type of grain growth modifier is useful to prepare tabular bands while another has not been explained.

Contemplated concentrations of the grain growth modifier for use in the tabular band growth process are from 0.1 to 500 millimoles per silver mole. A preferred grain growth modifier concentration is from 0.4 to 200 millimoles per silver mole, and an optimum grain growth modifier concentration is from 4 to 100 millimoles per silver mole.

Once the grain growth modifier has been introduced into the aqueous dispersion, tabular bands are grown on the high bromide tabular grains by providing the silver and bromide ions required to form the shell and holding the aqueous dispersion at any convenient temperature known to be compatible with grain ripening. This can range from about room temperature (e.g., 15° C.) up to the highest temperatures conveniently employed in silver halide emulsion preparation, typically up to about 90° C. A preferred holding temperature is in the range of from about 20° to 80° C., optimally from 35° to 70° C.

The holding period will vary widely, depending upon the starting grain population, the temperature of holding and the objective sought to be obtained. For example, starting with a high bromide tabular grain emulsion to provide the starting grain population with the objective of increasing mean ECD by a minimum 0.1 μm, a holding period of no more than a few minutes may be necessary in the 30° to 60° C. temperature range, with even shorter holding times being feasible at increased holding temperatures. On the other hand, if the starting grains are intended to form a minimal proportion of the final grain structure, holding periods can range from few minutes at the highest contemplated holding temperatures to overnight (16 to 24 hours) at ambient temperatures. The holding period is generally comparable to run times employed in preparing high bromide tabular grain emulsions by double jet precipitation techniques when the temperatures employed are similar. The holding period can be shortened by the introduction into the aqueous dispersion of a ripening agent of a type known to be compatible with obtaining thin (less than 0.2 μm mean grain thickness) tabular grain emulsions, such as thiocyanate or thioether ripening agents.

Grain growth modifiers of the iodo-8-hydroxyquinoline type have also been observed to be useful in growing tabular bands on high bromide tabular grain emulsions. The required iodo substituent can occupy any synthetically convenient ring position of the 8-hydroxyquinolines. When the 8-hydroxyquinoline ring is not otherwise substituted, the most active sites for introduction of a single iodo substituent are the 5 and 7 ring positions, with the 7 ring position being the preferred substitution site. Thus, when the 8-hydroxyquinoline contains two iodo substituents, they are typically located at the 5 and 7 ring positions. When the 5 and 7 ring positions have been previously substituted, iodo substitution can take place at other ring positions.

Further ring substitutions are not required, but can occur at any of the remaining ring positions. Strongly electron withdrawing substituents, such as other halides, pseudohalides (e.g., cyano, thiocyanato, isocyanato, etc.), carboxy (including the free acid, its salt or an ester), sulfo (including the free acid, its salt or an ester), α-haloalkyl, and the like, and mildly electron withdrawing or electron donating substituents, such as alkyl, alkoxy, aryl and the like, are common at a variety of ring positions on both of the fused rings of the 8-hydroxyquinolines.

Polar substituents, such as the carboxy and sulfo groups, can perform the advantageous function of increasing the solubility of the iodo-substituted 8-hydroxyquinoline in the aqueous dispersing media employed for emulsion precipitation.

In one specifically preferred form the iodo- 8-hydroxyquinolines satisfy the following formula:

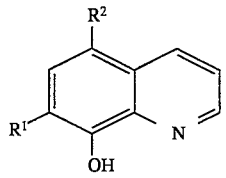

(II)

where $R^1$ and $R^2$ are chosen from among hydrogen, polar substituents, particularly carboxy and sulfo substituents, and strongly electron withdrawing substituents, particularly halo and pseudohalo substituents, with the proviso that at least one of $R^1$ and $R^2$ is iodo.

The following constitute specific illustrations of iodo-substituted 8-hydroxyquinoline grain growth modifiers contemplated for use in the practice of the invention:

| | |
|---|---|
| IHQ-1 | 5-Chloro-8-hydroxy-7-iodoquinoline |
| IHQ-2 | 8-Hydroxy-7-iodo-2-methylquinoline |
| IHQ-3 | 4-Ethyl-8-hydroxy-7-iodoquinoline |
| IHQ-4 | 5-Bromo-8-hydroxy-7-iodoquinoline |
| IHQ-5 | 5,7-Diiodo-8-hydroxyquinoline |
| IHQ-6 | 8-Hydroxy-7-iodo-5-quinolinesulfonic acid |
| IHQ-7 | 8-Hydroxy-7-iodo-5-quinolinecarboxylic acid |
| IHQ-8 | 8-Hydroxy-7-iodo-5-iodomethylquinoline |
| IHQ-9 | 8-Hydroxy-7-iodo-5-trichloromethyl-quinoline |
| IHQ-10 | α-(8-Hydroxy-7-iodoquinoline)acetic acid |
| IHQ-11 | 7-Cyano-8-hydroxy-5-iodoquinoline |
| IHQ-12 | 8-Hydroxy-7-iodo-5-isocyanatoquinoline |

Grain growth modifiers of the polyiodophenol type have additionally been observed to be useful in growing tabular bands on high bromide tabular grain emulsions. Polyiodophenols are arylhydroxides containing two or more iodo substituents.

In one simple form the phenol can be a hydroxy benzene containing at least two iodo substituents. It is synthetically most convenient to place the iodide substituents in at least two of the 2, 4 and 6 ring positions. When the benzene ring is substituted with only the one hydroxy group and iodo moieties, all of the possible combinations are useful as grain growth modifiers in the practice of the invention.

The hydroxy benzene with two or more iodo substituents remains a useful grain growth modifier when additional substituents are added, provided none of the additional substituents convert the compound to a reducing agent. Specifically, to be useful in the practice of the invention the phenol with two or more iodo substituents must be incapable of reducing silver chloride under the conditions of precipitation. Silver chloride is the most easily reduced of the photographic silver halides; thus, if a compound will not reduce silver chloride, it will not reduce any photographic silver halide. The reason for excluding compounds that are silver chloride reducing agents is that reduction of silver chloride as it is being precipitated creates Ag that produces photographic fog on processing.

Fortunately, phenols that are capable of reducing silver chloride are well known to the art, having been extensively studied for use as developing agents. For example, hydroquinones and catechols are well known developing agents as well as p-aminophenols. Thus, those skilled in the art through years of extensive investigation of developing agents have already determined which phenols are and are not capable of reducing silver chloride. According to James *The Theory of the Photographic Process,* 4th Ed., Macmillan, New York, 1977, Chapter 11, D. Classical Organic Developing Agents, 1. RELATION BETWEEN DEVELOPING ACTION AND CHEMICAL STRUCTURE, compounds that satisfy the following structure are developing agents:

$$a\text{-}(\overset{|}{C}{=}\overset{|}{C})_n\text{-}a'$$

where, in the case of a phenol, a is hydroxy, a' is hydroxy or amino (including primary, secondary or tertiary amino), and n=1, 2 or 4.

From the foregoing it is apparent that the overwhelming majority of phenol substituents in addition to the required hydroxy and iodo substituents are incapable of rendering the phenols reducing agents for silver chloride. Such additional substituents, hereinafter referred to as photographically inactive substituents, include, but are not limited to, the following common classes of substituents for phenols: alkyl, cycloalkyl, alkenyl (e.g., allyl), alkoxy, aminoalkyl, aryl, aryloxy, acyl, halo (i.e., F, Cl or Br), nitro ($NO_2$), and carboxy or sulfo (including the free acid, salt or ester). All aliphatic moieties of the above substituents preferably contain from 1 to 6 carbon atoms while all aryl moieties preferably contain from 6 to 10 carbon atoms. When the phenol contains two iodo substituents and an additional, photographically inactive substituent, the latter is preferably located para to the hydroxy group on the benzene ring.

It has been demonstrated that phenols contain two or three iodo substituents are highly effective as grain growth modifiers, but that phenols with a single iodo substituent are ineffective. This was not predicted and is, in fact, quite unexpected.

There are, of course, many varied phenols known to the art that are available for selection as grain growth modifiers in the practice of the invention. The following are specific illustrations of polyiodophenol grain growth modifiers contemplated for use in the practice of the invention:

2,6-diiodophenol PIP-1

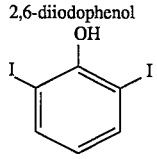

2,4,6-triiodophenol PIP-2

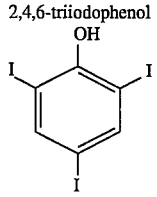

2,6-diiodo-4-nitrophenol PIP-3

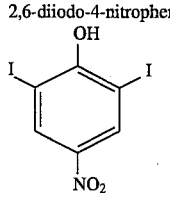

2,6-diiodo-4-methylphenol PIP-4

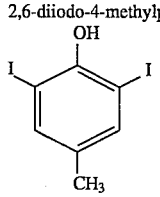

4-allyl-2,6-diiodophenol PIP-5

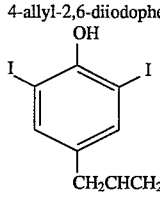

4-cyclohexyl-2,6-diiodophenol PIP-6

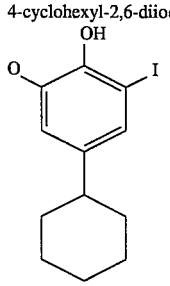

2,6-diiodo-4-phenylphenol PIP-7

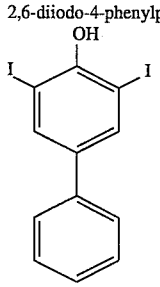

4,6-diiodo-2-acetophenone

-continued

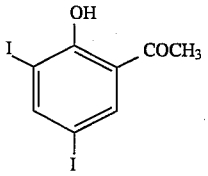

4,6-diiodothymol

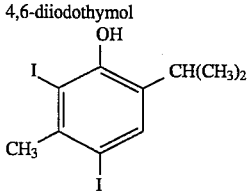

4,6-diiodocarvacrol

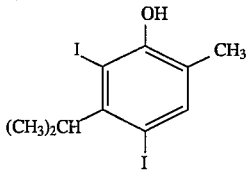

3,5-diiodo-L-tyrosine

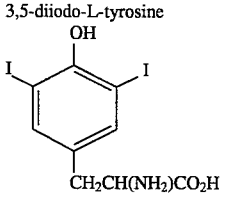

3',3",5',5"-tetraiodophenolphthalein

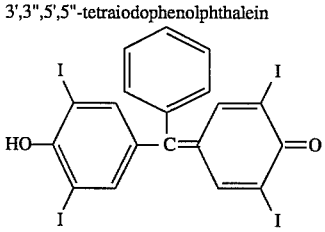

erythrosin

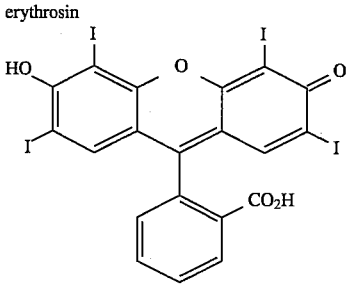

rose bengal

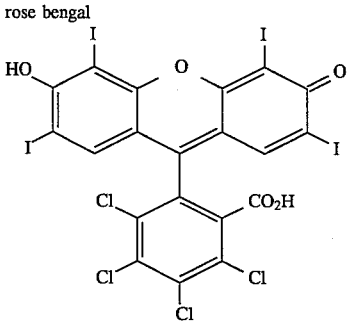

PIP-8 The procedures for using the iodo-8-hydroxyquinoline and polyiodophenol grain growth modifiers are similar to those described in detail for using the 4,5,6-triaminopyrimidine grain growth modifiers, except for the following differences: When an iodo-8-hydroxyquinoline grain growth modifier is employed, the pH of the dispersing medium can range from 2 to 8, preferably from 3 to 7. When a polyiodophenol grain growth modifier is employed, the pH of the dispersing medium can range from 1.5 to 10, preferably PIP-9 from 2 to 7. When an iodo-8-hydroxyquinoline or polyiodophenol grain growth modifier is employed, the ripening temperature is preferably at least 40° C.

Instead of forming the central portion of the tabular grains by conventional procedures it is alternatively possible to form the entire tabular grain structure by precipitation in the presence of a selected grain growth modifier of the type PIP-10 described above. The adaptation of the process of preparation requires only that the level of iodide be varied from a relatively high level when the central region of the grain is being precipitated to a relatively low level of iodide when the band is being precipitated.

Apart from the features that have been specifically disclosed, the emulsions of the invention, their preparation and photographic elements containing these emulsions can take PIP-11 any convenient conventional form. Conventional features are illustrated by *Research Disclosure,* Vol. 365, September 1994, Item 36544.

EXAMPLES

The invention can be better appreciated by reference to the following specific examples.

PIP-12

EMULSION A

AgIBr (25 mole % I) Ultrathin Tabular Grain Emulsion to be Used as Host Grains

To a vigorously stirred reaction vessel containing 50 g oxidized gelatin and 2L distilled water at 25° C. was added 300 mL of 2M $AgNO_3$ solution at a rate of 300 mL per min using two pumps and a 12-hole ring outlet. A 1.5M NaBr, PIP-13 0.5M KI solution was simultaneously added at a rate needed to maintain a pBr of 3.82 using two pumps and a 12-hole ring outlet. The silver and halide introducing ring outlets were mounted above and below a rotated stirring head, respectively. To 90 g of the resulting emulsion at 25° C. was added 4 mL of an aqueous solution containing a total of 16 mmole per mole silver of 4,5,6-triaminopyrimidine. The temperature was increased to 40° C. then the pH was adjusted to 7.0 and the pBr to 3.38. The mixture was heated to 60° C. and the pH was adjusted to 7.0 and the pBr to 3.08. The emulsion was heated for 1.5 hr at 60° C. resulting in a PIP-14 tabular grain emulsion.

The average ECD of the grains was determined by measuring 2124 grains by electron microscopy to be 0.29 μm. The average tabular grain thickness was obtained using atomic force microscopy (AFM) by scanning 1159 tabular grains and by scanning 80 gelatin shells to obtain an averaged adsorbed gelatin layer thickness. The measured gelatin thickness of 0.0049 μm was subtracted from this overall grain thickness. The corrected average thickness was 0.0261 μm. The mean aspect ratio was 11. The tabular grain population was 85% of the total projected area of the emulsion grains.

The luminescence of individual grains was examined through an ultraviolet to 530 nm filter at 77° K. using a low temperature luminescence microscope (J. Maskasky, *J. Imaging Sci.* 32:15(1988). The tabular grains showed no luminescence at 77° K. The lack of observable luminescence at 77° K. was attributed to their extremely high and uniform iodide concentration.

EMULSION B

AgBr Fine Grain Emulsion

To a vigorously stirred reaction vessel containing 50 g oxidized gelatin and 2L distilled water at 25° C. was added 300 mL of 2M $AgNO_3$ solution at a rate of 300 mL per min using two pumps and a 12-hole ring outlet. A 2.0M NaBr solution was simultaneously added at a rate needed to maintain a pBr of 3.82 using two pumps and a 12-hole ring outlet. The silver and halide introducing ring outlets were mounted above and below a rotated stirring head, respectively.

EMULSION C

AgIBr (6 mole % I) Ultrathin Tabular Seed Grain Emulsion

To a vigorously stirred reaction vessel at 25° C. containing 2L of a solution that was 0.38% in oxidized gelatin and 0.15 mmolar in NaBr was added 75 mL of 2M $AgNO_3$ solution at a rate of 300 mL per min using two pumps and a 12-hole ring outlet. A 1.88M NaBr, 0.12M KI solution was simultaneously added at a similar rate using two pumps and a 12-hole ring outlet. The silver and halide introducing ring outlets were mounted above and below a rotated stirring head, respectively. The final pBr was 2.78. It was adjusted to a pH of 6.0, pBr of 2.6 at 40° C. then the temperature was increased to 60° C. at a rate of 5° C. per 3 min, then the pH was maintained at 6.0 and the pBr at 2.38. After heating at 60° C. for 90 min, the emulsion was cooled to 25° C., the pBr adjusted to 3.82, and the pH to 7.0.

The resulting emulsion was comprised of ultrathin tabular grains having an approximate ECD of 0.1 μm forming more than 95% of the total projected area of the emulsion grains.

EMULSION D

AgIBr (25 mole % I) Ultrathin Tabular Grain Seeded Emulsion to be Used as Host Grains To a vigorously stirred reaction vessel containing 50 g oxidized gelatin and 2L distilled water at 25° C. was added 300 mL of 2M $AgNO_3$ solution at a rate of 300 mL per min using two pumps and a 12-hole ring outlet. A 1.5M NaBr, 0.5M KI solution was simultaneously added at a rate needed to maintain a pBr of 3.82 using two pumps and a 12-hole ring outlet. The silver and halide introducing ring outlets were mounted above and below a rotated stirring head, respectively. To the resulting emulsion at 25° C. and pH 7.0 was added 200 mL of an aqueous solution containing 13.5 mmoles of an aqueous solution containing 4,5,6-triaminopyrimidine adjusted to pH 7.0 and 0.075 mole of Emulsion C. The temperature was increased to 60° C. and held at this temperature for 90 min with no pH or pBr adjustments.

The average ECD of the grains was determined by measuring 2420 grains by electron microscopy, to be 0.21 μm. The average tabular grain thickness was obtained using atomic force microscopy (AFM) by scanning 1509 tabular grains. After correcting for the adsorbed gelatin layer thickness (0.0049 μm), the average thickness was 0.032 μm. The tabular grain population accounted for 95% of the total projected area of the emulsion grains.

X-ray powder diffraction using $CuK_B$ radiation of the resulting emulsion showed two different silver halide phases were present. One had a mean iodide content of 6.3 mole percent and formed 9% of the total silver, and the other had a mean iodide content of 24.1 mole percent and formed 91% of the total silver.

EXAMPLE 1

Iodide-Rich (~25 mole % I) Host, Low Iodide (1 mole % I) Annularly Banded Ultrathin (5 mole % Total I) Tabular Grain Emulsion To 5.2 mmole of Emulsion A at 40° C. with stirring was added 20.8 mmole of Emulsion B and 0.33 mmole of 4,5,6-triaminopyrimidine dissolved in 4 mL of water. The mixture was adjusted a pH of 7.0, pBr of 3.38. The mixture was heated to 60° C. adjusted to a pH of 7.0, pBr of 3.08. After heating for 1.5 hr at 60° C., the resulting emulsion was cooled.

The average tabular grain dimensions were obtained using atomic force microscopy (AFM) by scanning 1084 tabular grains to obtain an average overall tabular grain thickness and diameter, and by scanning 80 gelatin shells to obtain an averaged adsorbed gelatin layer thickness. The measured gelatin thickness of 0.0049 μm was subtracted from the overall grain thickness. The corrected average thickness was 0.0261 μm (identical to that of the host tabular grains) and the average grain ECD was 0.630 μm. The mean aspect ratio was 24. The tabular grain population accounted for 85% of the total projected area of the emulsion grains.

Figure 5:
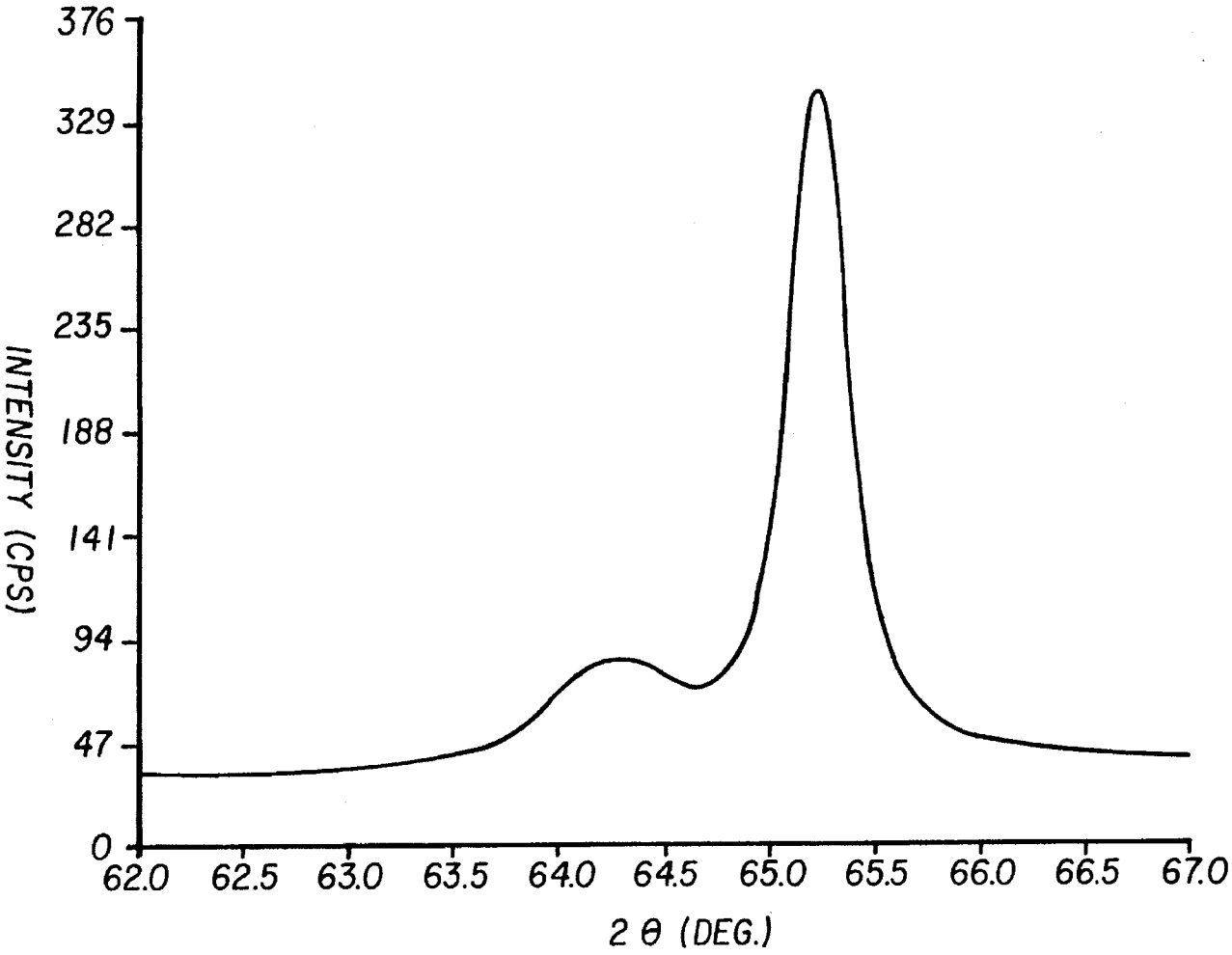
FIG. 5 is an X-ray powder diffraction pattern of an emulsion of the invention using $CuK_B$ radiation.

X-ray powder diffraction using $CuK_B$ radiation of the resulting emulsion showed two different silver halide phases were present. One had a mean iodide content of 22.1 mole percent, and the other had a mean iodide content of 0.9 mole percent. The powder diffraction profile is shown in FIG. 5.

EXAMPLE 2

Seeded Iodide-Rich (~25 mole % I) Host, Low Iodide (1 mole % I) Annularly Banded Ultrathin Tabular Grain Emulsion To 0.6 mole of Emulsion B at 40° C. with stirring was added 0.15 mole of Emulsion D and 9.6 mmole of 4,5,6-triaminopyrimidine dissolved in 150 mL of water. The mixture was adjusted a pH of 7.0, pBr of 3.38. The mixture was heated to 60° C. adjusted to a pH of 7.0, pBr of 3.08. After heating for 1.5 hr at 60° C., the resulting emulsion was cooled.

Then 2.1 mmoles of calcium nitrate dissolved in 20 mL water and 1.72 mmole of Dye A dissolved in 35 mL methanol were added. (Dye A is anhydro-5-chloro- 9-ethyl-5'-phenyl-3'-(3-sulfobutyl)-3-(3-sulfopropyl)oxacarbocyanine hydroxide, triethylamine salt.) The mixture was stirred for 15 min at 40° C. then the emulsion was washed by the coagulation method of Yutzy and Russell, U.S. Pat. No. 2,614,929.

The average tabular grain dimensions were obtained using atomic force microscopy (AFM) by scanning 786 tabular grains to obtain an average overall tabular grain thickness and diameter. The measured gelatin shell thickness of 0.007 μm was subtracted from the overall grain thickness. The corrected average thickness was 0.034 μm and the average grain ECD was 0.50 μm. Although tabular grain thickness increased slightly (0.001 μm adjacent each major face), the iodide concentration at the portions of the {111} major faces corresponding to the major faces of the host tabular grains was not detectibly lowered. The mean aspect ratio was 15. The tabular grain population accounted for 95% of the total projected area of the emulsion grains.

X-ray powder diffraction using $CuK_B$ radiation of the resulting emulsion showed that two predominate silver halide phases were present. The main phase had an average iodide content of 0.8 mole percent, and the other predominate phase had an iodide content of 23 mole percent.

The luminescence of individual grains was examined through an ultraviolet to 530 nm filter at 77° K. using a low temperature luminescence microscope (J. Maskasky, *J. Imaging Sci.* 31:15(1987). Approximately 90% of the tabular grain population showed a green luminescent annular band, a non-luminescent core, and a green luminescent small central dot. The low iodide containing phases (the ~1 mole % I annular band and the 6 mole % I seed) were the strongly luminescent phases.

The invention has been described in detail with particular reference to preferred embodiments thereof, but it will be understood that variations and modifications can be effected within the spirit and scope of the invention.

What is claimed is:

1. A radiation-sensitive emulsion comprised of a dispersing medium and silver halide grains, at least 50 percent of total grain projected area being accounted for by tabular grains of a face centered cubic crystal lattice structure comprised of greater than 50 mole percent bromide, based on total silver, and having parallel {111} major faces and an average aspect ratio of at least 5, the tabular grains being comprised of regions differing in iodide concentrations, wherein one of the regions is a central region containing greater than 7 mole percent iodide, based on silver forming the central region, a second of the regions is an annular band containing less than half the iodide concentration of the central region, and the central region and the annular band each extend between and form a portion of the {111} major faces, with the central region and annular band each forming at least 5 percent of each {111} major face, and the emulsion contains a 4,5,6-triaminopyrimidine, a polyiodophenol or an iodo-8-hydroxyquinoline grain growth modifier.

2. A radiation-sensitive emulsion according to claim 1 wherein the tabular grains accounting for at least 50 percent of total grain projected area have an average thickness of less than 0.2 μm.

3. A radiation-sensitive emulsion according to claim 2 wherein the tabular grains accounting for at least 50 percent of total grain projected area have an average thickness of less than 0.07 μm.

4. A radiation-sensitive emulsion according to claim 1 wherein the central region forms at least 80 percent of the {111} major faces.

5. A radiation-sensitive emulsion according to claim 1 wherein the annular band contains less than 2 mole percent iodide, based on total silver forming the band.

6. A radiation-sensitive emulsion according to claim 5 wherein the annular band contains at least 0.1 mole percent iodide, based on total silver forming the band.

7. A radiation-sensitive emulsion comprised of a dispersing medium and silver halide grains, at least 70 percent of total grain projected area being accounted for by tabular grains of a face centered cubic crystal lattice structure comprised of greater than 70 mole percent bromide, based on total silver, and having parallel {111} major faces and an average aspect ratio of at least 5, the tabular grains comprised of regions differing in iodide concentrations, wherein one of the regions is a central region containing from greater than 7 to 30 mole percent iodide, based on silver, the central a second of the regions is an annular band containing less than 2 mole percent iodide, based on silver forming the annular band, the central region and the annular band each extend between and form a portion of the {111} major faces, with the central region forming at least 80 percent of each {111} major face and the annular band forming from 5 to 20 percent of each {111} major face, and the emulsion contains a 4,5,6-triaminopyrimidine, a polyiodophenol or an iodo-8-hydroxyquinoline grain growth modifier.

* * * * *